US008475656B1

(12) United States Patent
Neumann

(10) Patent No.: US 8,475,656 B1
(45) Date of Patent: Jul. 2, 2013

(54) FLOATING SURFACE SKIMMER

(76) Inventor: Michael E. Neumann, Tarpon Spriings, FL (US)

( * ) Notice: Subject to any disclaimer, the term of this patent is extended or adjusted under 35 U.S.C. 154(b) by 472 days.

(21) Appl. No.: 12/839,862

(22) Filed: Jul. 20, 2010

(51) Int. Cl.
*E04H 4/16* (2006.01)

(52) U.S. Cl.
USPC ..... 210/167.1; 210/242.1

(58) Field of Classification Search
USPC ..... 210/167.1, 167.15, 242.1, 242.2, 210/242.3
See application file for complete search history.

(56) References Cited

U.S. PATENT DOCUMENTS

| | | | | | |
|---|---|---|---|---|---|
| 3,108,298 | A | * | 10/1963 | Gelinas | 15/1.7 |
| 3,297,163 | A | * | 1/1967 | Landon | 210/331 |
| 3,718,148 | A | * | 2/1973 | Gibellina | 134/167 R |
| 3,762,557 | A | * | 10/1973 | Tudor et al. | 210/242.3 |
| 3,820,172 | A | * | 6/1974 | Kane | 4/490 |
| 4,301,008 | A | * | 11/1981 | Baffert et al. | 210/242.3 |
| 4,333,829 | A | * | 6/1982 | Walther | 210/167.21 |
| 4,802,592 | A | * | 2/1989 | Wessels | 210/167.1 |
| 4,818,389 | A | * | 4/1989 | Tobias et al. | 210/167.12 |
| 5,133,854 | A | * | 7/1992 | Horvath | 210/121 |
| 5,143,605 | A | | 9/1992 | Masciarelli | |
| 5,413,707 | A | * | 5/1995 | Shatilov | 210/167.21 |
| 5,498,348 | A | | 3/1996 | Plink et al. | |
| 5,897,773 | A | * | 4/1999 | Rhodes | 210/232 |
| 6,027,641 | A | * | 2/2000 | Spradbury et al. | 210/167.2 |
| D432,206 | S | | 10/2000 | Stoltz et al. | |
| 6,299,765 | B1 | * | 10/2001 | Fabrizio | 210/167.27 |
| 6,709,582 | B2 | * | 3/2004 | Danner | 210/170.02 |
| 7,179,373 | B1 | * | 2/2007 | Wehmeyer et al. | 210/167.23 |

OTHER PUBLICATIONS http://www.aquapoolstore.com/cleaners/Polaris-LCS-Leaf-trap.htm, accessed on Jun. 14, 2010.
http://www.poolcenter.com/polaris-LCS.jpg, accessed on Jun. 14, 2010.
http://www.gatorsa.co.za/Features.htm, accessed on Jun. 13, 2010.
http://www.usaink.com/dragonfly, accessed on Jun. 13, 2010.
http://www.inyopools.com/Products/07501352017494.htm, accessed on Jun. 13, 2010.

* cited by examiner

*Primary Examiner* — Fred Prince
(74) *Attorney, Agent, or Firm* — Michele L. Lawson; Smith & Hopen, P.A.

(57) ABSTRACT

A floating skimmer that is adapted to float on the surface of the water to collect surface debris. The skimmer comprises an inlet connected to a substantially tubular body having an intake port. The substantially tubular body connects to a conduit assembly having an outlet port connecting to the hose of an external suction pump. The conduit assembly may have a plurality of ports such as an intake pipe for connection to an underwater vacuum and a tubing input assembly. The tubing input assembly connects to flexible inlet tubes of various lengths to allow the flow of water and debris from various depths of the pool into the skimmer. In operation, the debris collected from the various intake pipes and ports is removed from the skimmer through suction provided from the external suction pump. This skimmer allows debris to be collected from the surface of the pool as well as from various depths in the pool.

14 Claims, 5 Drawing Sheets

FLOATING SURFACE SKIMMER

FIELD OF INVENTION

This invention relates to surface skimmers. Specifically this invention relates to a mobile floating surface skimmer that can remove floating debris from the surface of a body of water.

BACKGROUND OF THE INVENTION

Swimming pools are known to collect various types of debris including leaves, insects, and various other floating debris. Skimmers are generally used to clean the swimming pool of floating debris. Skimmers are normally openings that are incorporated into the walls of the swimming pool and are connected by a hose to the swimming pool pump. In theory, wave action in the pool will push the floating debris towards the edge of the pool and into the skimmers where it is then sucked into a trap by the suction of the pool pump. This system is inefficient in that not all debris is effectively pushed into the skimmers. Further, fluctuations in water level can greatly affect the operation and efficiency of these skimmers.

In order to address the problems with skimmers incorporated into the walls of the pool, several types of pool skimmers have been developed. Static skimmers, manual skimmers and skimmers that float on the surface of the water are the most common. Several of the skimmers that float on the water require extra pipes, pumps and water jets for propulsion. Further, some of the floating skimmers contain collection containers that must be cleaned out regularly in order to effectuate efficient operation thus these skimmers cannot be used continuously.

In addition to surface skimmers, underwater "vacuums" have been developed to clean the bottom floor of the pool. However, no device has been developed that incorporates continuous total pool cleaning, both surface and underwater.

Surface skimmers are also used in larger bodies of water to remove debris from the body of water. For example, surface skimmers have been used to remove oil from the surface of oceans and lakes.

SUMMARY OF INVENTION

In one embodiment of the present invention is a skimmer device that can be used to remove debris such as leaves, dust, dirt and bugs from the surface of a body of water such as a swimming pool. The device is comprised of an inlet, a substantially tubular body having an intake port and at least one flotation apparatus. The inlet has a plurality of weirs that are disposed around the periphery of its first end to allow surface water to enter the inlet. The inlet can be tapered at its second end.

The substantially tubular body attaches to the second end of the inlet and is in substantially open fluid communication with the inlet. The substantially tubular body has an intake port on one side, which provides fluid communication between the outside and inside of the substantially tubular body. The intake port may have a valve to restrict the inflow of water in some embodiments. The substantially tubular body can also have an outlet port, which provides fluid communication between the outside and inside of the substantially tubular body.

The device is also comprised of at least one flotation apparatus that can be attached to the skimmer by any means and in any configuration to allow the skimmer to float on the surface of the water so that the weirs are located slightly below the surface of the water. In one embodiment, the at least one flotation apparatus is directly attached to the substantially tubular body. In other embodiments, the flotation apparatus can be attached to the device by at least one flotation assembly. This flotation assembly can attach to any point on the conduit assembly or the substantially tubular body.

The device can be further comprised of a conduit assembly that is attached to the second end of the substantially tubular body. The conduit assembly can contain a plurality of ports. In one embodiment, the conduit assembly contains the outlet port. The outlet port can be adapted to attach a hose of an external suction pump or other external vacuum pump.

One of the plurality of ports of the conduit assembly can be a tubing input assembly that attaches to a plurality of flexible tubes of different lengths. Another of the ports of the conduit assembly can be attached to the hose of an underwater vacuum.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
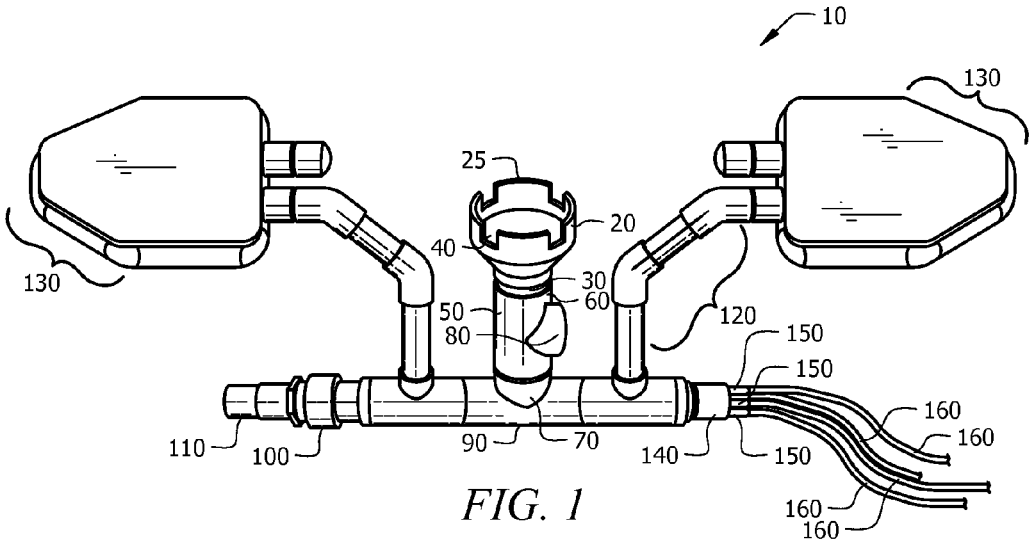
FIG. 1 is a perspective view of one embodiment of the invention.
Figure 2:
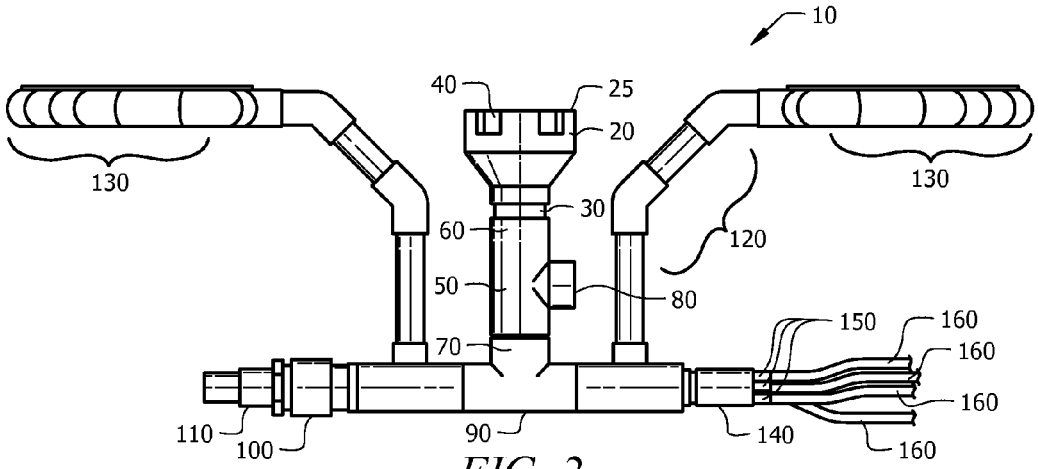
FIG. 2 is a side view of one embodiment of the invention.
Figure 3:
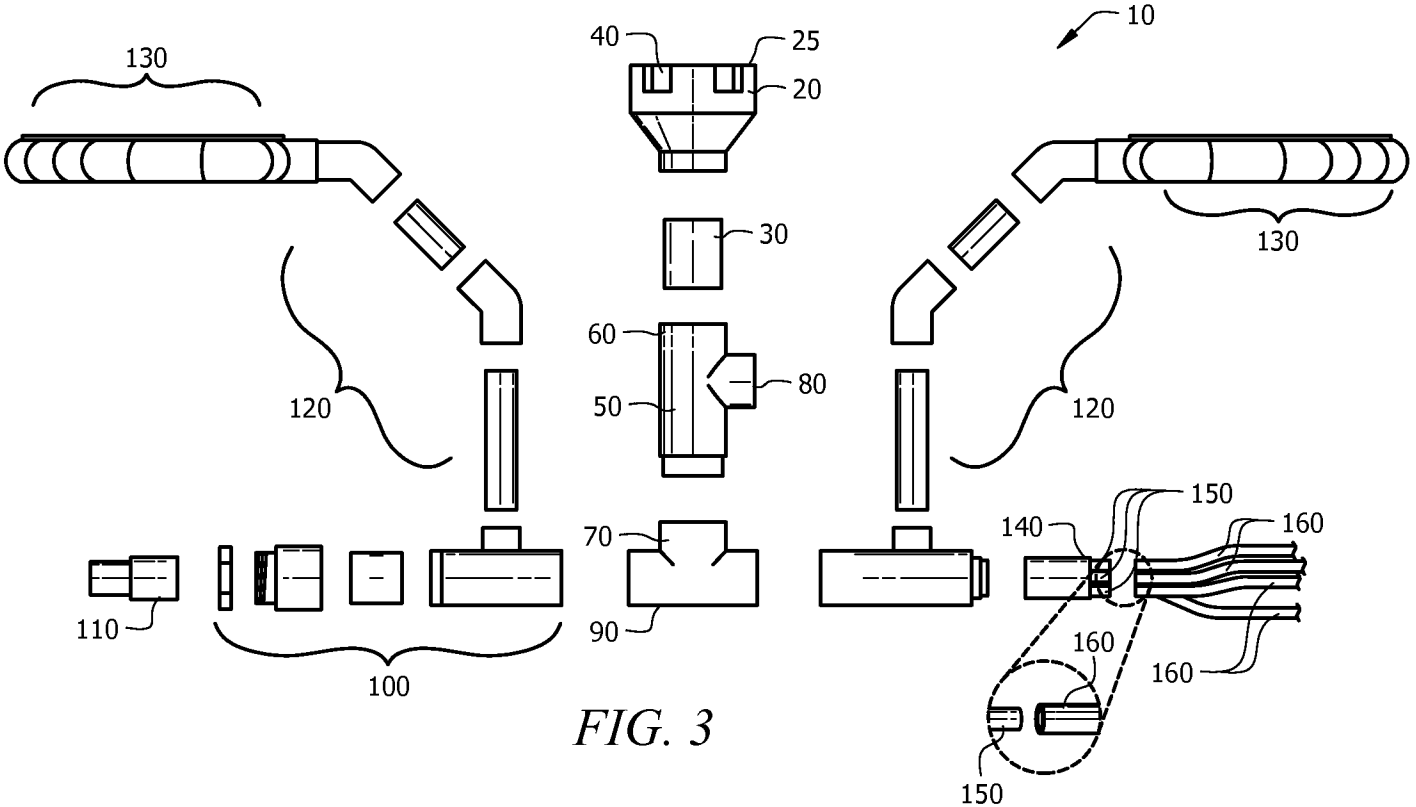
FIG. 3 is an exploded view of one embodiment of the invention.
Figure 4:
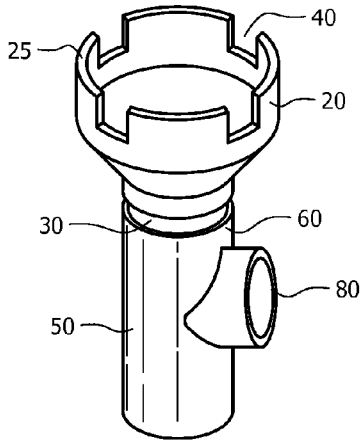
FIG. 4 is a perspective view of the substantially tubular body with the intake port.
Figure 5:
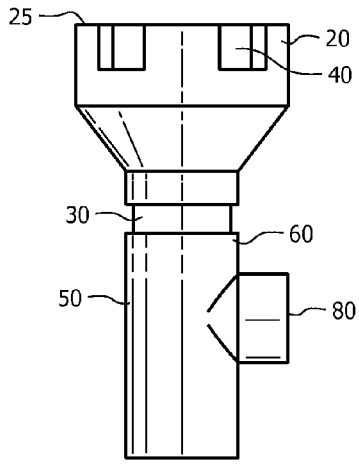
FIG. 5 is a side view of the substantially tubular body with the intake port.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The word "substantially" is defined as those materials or steps that do not materially affect the basic and novel characteristics of the claimed invention.

"Substantially open fluid communication" refers to a connection between parts of the invention that is free of obstacles or encumberances. There is no mechanical device positioned between the parts being connected thus the flow of materials through the different parts of the invention is not restricted in any way.

"External suction pump" refers to a pump that is external to the floating skimmer. The pump is capable of providing suction when attached to the skimmer to remove water and debris from the skimmer. The pump may be within the body of water or may be outside the body of water. One example of an external suction pump is a pool pump.

The present invention describes a floating skimmer 10 comprised of an inlet 20, a substantially tubular body 50, an intake port 80, an outlet port 100, and at least one flotation apparatus 130. At its most basic embodiment, the inlet 20 has a plurality of notches disposed around the periphery of its first end 25 that act as weirs 40 to allow surface water to enter the inlet 20. The second end 30 of the inlet 20 is in substantially open fluid communication with the first end 60 of a substantially tubular body 50. An intake port 80 is disposed in one side of the substantially tubular body 50 to allow water to flow from the outside to the inside of the substantially tubular body 50. An outlet port 100 can be disposed in on side of the substantially tubular body 50 with the outlet port 100 allowing the water to exit the substantially tubular body 50. The device also is comprised of at least one flotation apparatus 130 that can be attached by any means to the device to allow the skimmer to float on the surface of the water so that the weirs 40 are positioned slightly below the surface of the water.

The apparatus of the first embodiment of the floating skimmer 10 includes a hollow tapered inlet 20. The first end of the inlet 20 has a plurality of notches spaced along the perimeter of the inlet 20 that act as weirs 40. When the floating skimmer 10 is placed in a body of water, the bottom edge of the weirs 40 are positioned slightly beneath the surface of the body of water to enable the surface water to enter the inlet 20.

The inlet 20 has a circular cross-section and a first end 25 and a second end 30. The inlet 20 is wider at the first end 25 and tapers downwards to the second end 30. The second end 30 of the inlet 20 connects to the first end 60 of the substantially tubular body 50. The second end 30 of the inlet 20 can have a diameter slightly less than the diameter of the first end 60 of the substantially tubular body 50 to allow the second end 30 of the inlet 20 to be inserted into the first end 60 of the substantially tubular body 50 to provide a leak-proof fit.

The substantially tubular body 50 has an intake port 80 extending laterally from one side. The intake port 80 in one embodiment is located substantially half way between the first end 60 of the substantially tubular body 50 and the second end 70 of the substantially tubular body 50; however, the intake port 80 can be positioned at any point on the substantially tubular body 50. The intake port 80 allows water and debris to flow into the substantially tubular body 50. Subsequently the debris can exit the floating skimmer 10 through the outlet nozzle 110. The intake port 80 may contain a valve (not shown) that can be operated manually or automatically to stop the flow of water through the intake port 80 when the inflow of water is increased. The water level may be increased by factors such as the utilization of other intake ports for example, the combination of the tubing input assembly 140 and the intake pipe 170 which can be attached to the hose of an underwater vacuum cleaner that is used to clean the bottom of a pool. The intake port 80 provides another input for the surface water, in addition to the multiple weirs 40 located in the inlet 20, to enter the floating skimmer 10. This additional input for water allows more of the surface water to be filtered and more of the debris to be removed from the pool.

The second end 70 of the substantially tubular body 50 is connected to a conduit assembly 90. In a first embodiment, the conduit assembly 90 is positioned substantially perpendicularly to the substantially tubular body 50. The conduit assembly 90 has a plurality of ports. One of the plurality of ports can be an outlet port 100 having an open end. An outlet nozzle 110 can attach to the open end of the outlet port 100. The outlet nozzle 110 can be attached to a hose that attaches to an external suction pump, such as a pool suction pump, to provide suction through the floating skimmer 10. The suction pulls the water and debris that enters through the various inlets of the floating skimmer 10 through the hose attached to the suction pump and therefore removes debris from the water of the pool. The outlet nozzle 110 can be of various diameters to accommodate different size hoses of the external suction pump.

One of plurality of ports of the conduit assembly 90 can attach a tubing input assembly 140 that consists of a tube having a first end connected to the conduit assembly 90 and a second end having numerous tube inlets 150. Each tube inlet 150 connects to a separate flexible inlet tube 160. Each of the flexible inlet tubes 160 is of a different length to allow the floating skimmer 10 to acquire water and debris from different depths in the water. Another of the plurality of ports of the conduit assembly 90 can attach to the hose of an underwater vacuum cleaner that is used to clean the bottom of a pool. Any of the ports of the conduit assembly 90 can have a cap or valve to restrict the flow of water when needed.

The floating skimmer 10 floats on the surface of the pool using at least one flotation apparatus 130. The flotation apparatus 130 can be in any shape, size and orientation as long as it is capable of keeping the floating skimmer 10 buoyant so that the weirs 40 are positioned slightly below the surface of the body of water to allow water to enter the inlet 20. The flotation apparatus 130 can be made of any material that allows flotation such as waterproof foam or alternatively can have an air pocket located within that allows flotation. The flotation apparatus 130 can attach to the floating skimmer 10 by any means known by those of skill in the art and further can attach at any location on the floating skimmer 10 as long as when the device is floating on the surface of the pool, the weirs 40 are located slightly beneath the surface of the water to allow water to flow into the device. For example, the flotation apparatus 130 can be supported by a flotation assembly 120, which can extend from the conduit assembly 90 or the substantially tubular body 50. The flotation assembly 120 can be in any configuration, orientation, size, or shape. Alternatively, in some embodiments, the flotation apparatus 130 surrounds the substantially tubular body 50 and there is no need for a flotation assembly.

The floating skimmer 10 can be manufactured in various configurations but preferably the substantially tubular body 50 is positioned vertically with the bottom edge of the weirs 40 positioned slightly below the surface of the water to allow surface water to enter the inlet 20. The conduit assembly 90 can be made in any shape, size or configuration and can attach to the second end 70 of the substantially tubular body 50 in any direction (i.e. vertically, horizontally, diagonally, etc.) depending on the configuration of the conduit assembly 90. The conduit assembly 90 can have one or more intake pipes or ports and at least one outlet port 100. The intake pipes or ports and outlet port 100 can be arranged in any configuration in the conduit assembly 90. The flotation apparatus can take any form as long as it is capable of supporting the floating skimmer 10 to ensure that the bottom edge of the weirs 40 are located slightly below the surface of the water to allow water to enter the inlet 20.

Figure 6:
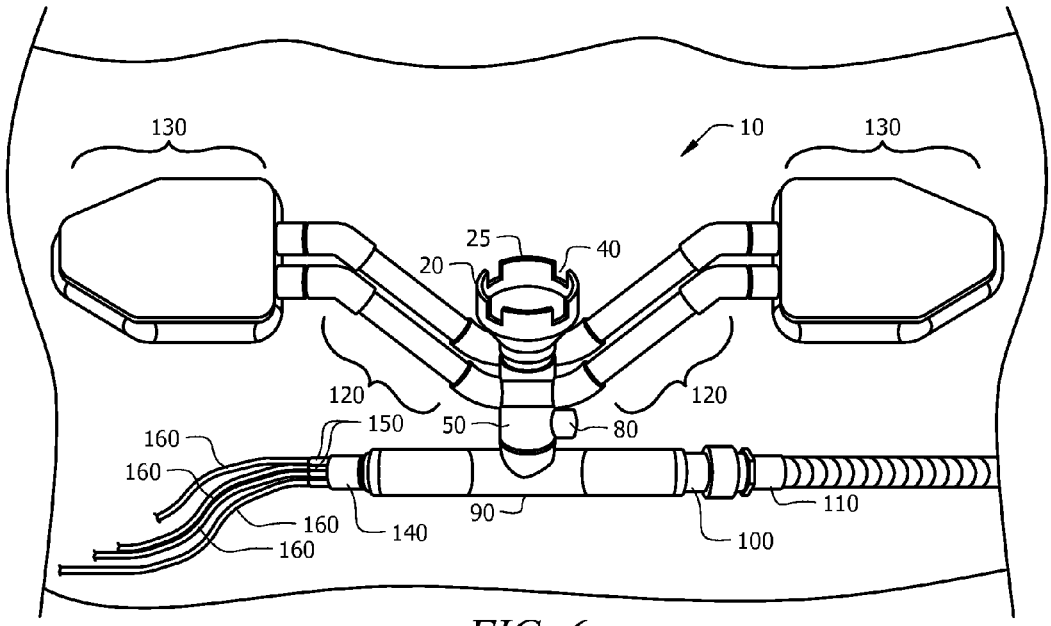
FIG. 6 is a perspective view of another embodiment of the invention showing a different connection for the flotation apparatus.
Figure 7:
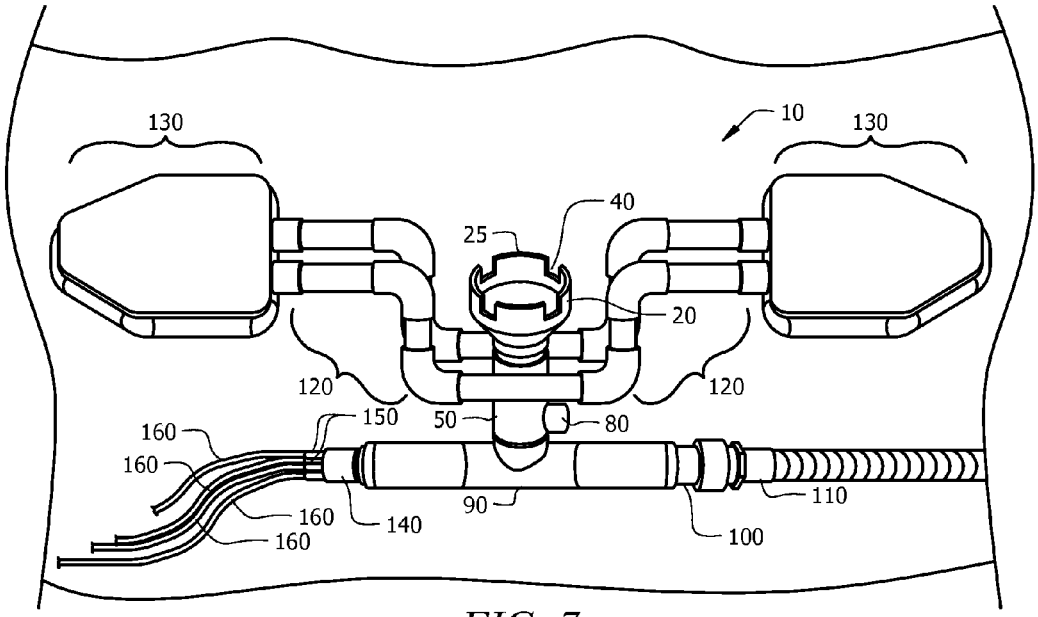
FIG. 7 is a perspective view of another embodiment of the invention showing a different connection for the flotation apparatus.

FIGS. 1-3 and 6-9, for example, illustrate different flotation assemblies and apparatuses for various embodiments of the invention. As shown in FIG. 1, a pair of flotation assemblies 120 can extend vertically from the conduit assembly 90 to support a pair of flotation apparatuses 130. As shown in FIG. 6, a pair of flotation assemblies 120 can extend radially from either side of the substantially tubular body 50. Another embodiment, as shown in FIG. 7, illustrates a pair of flotation assemblies 120 extending first laterally then vertically then laterally again at right angles from the substantially tubular body 50 to attach to the flotation apparatus 130.

Figure 8:
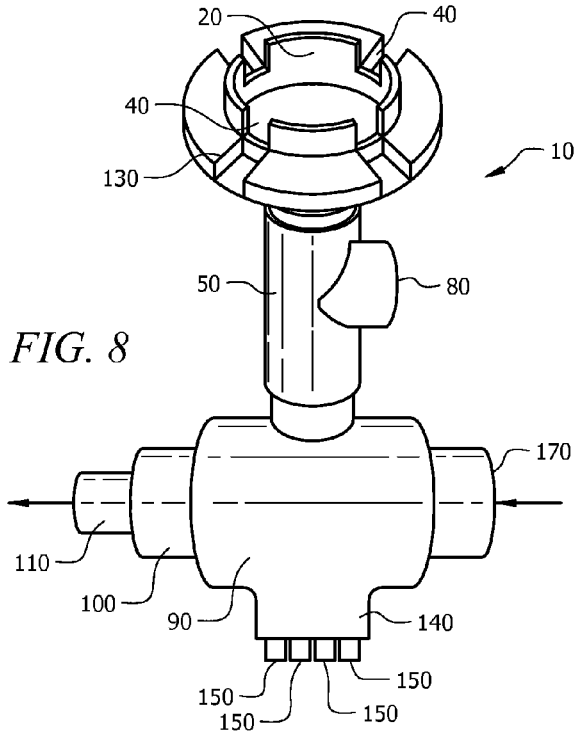
FIG. 8 is a perspective view of another embodiment of the invention showing a different configuration for the conduit assembly with an additional intake pipe.

FIG. 8 shows another embodiment of the present invention. In this embodiment, the substantially tubular body 50 attaches to the conduit assembly 90. The substantially tubular body 50 has an intake port 80 to allow water to flow into the substantially tubular body 50. The intake port 80 can contain a valve (not shown) to stop the flow of water into the intake port 80 when water is flowing into both the tubing input assembly 140 and the intake pipe 170. This valve can be manually operated or may automatically close when the flow of water reaches a certain level. The conduit assembly 90 in this embodiment is substantially vertical and consists of an intake pipe 170 connected to a hose from an underwater vacuum system; a tubing input assembly 140; and an outlet port 100. The intake pipe 170, tubing input assembly 140 and outlet port 100 can be arranged in any configuration in the conduit assembly 90. As shown in the first embodiment of the invention, the tubing input assembly 140 is detachable and consists of a tube having a first end connected to the conduit assembly 90 and a second end having numerous tube inlets 150. Each tube inlet 150 connects to a separate flexible inlet tube 160. Each of the flexible inlet tubes 160 is of a different length to allow the floating skimmer 10 to acquire debris from different depths in the water. The flotation apparatus 130 in this embodiment is substantially circular and is positioned to encircle the inlet 20.

Figure 9:
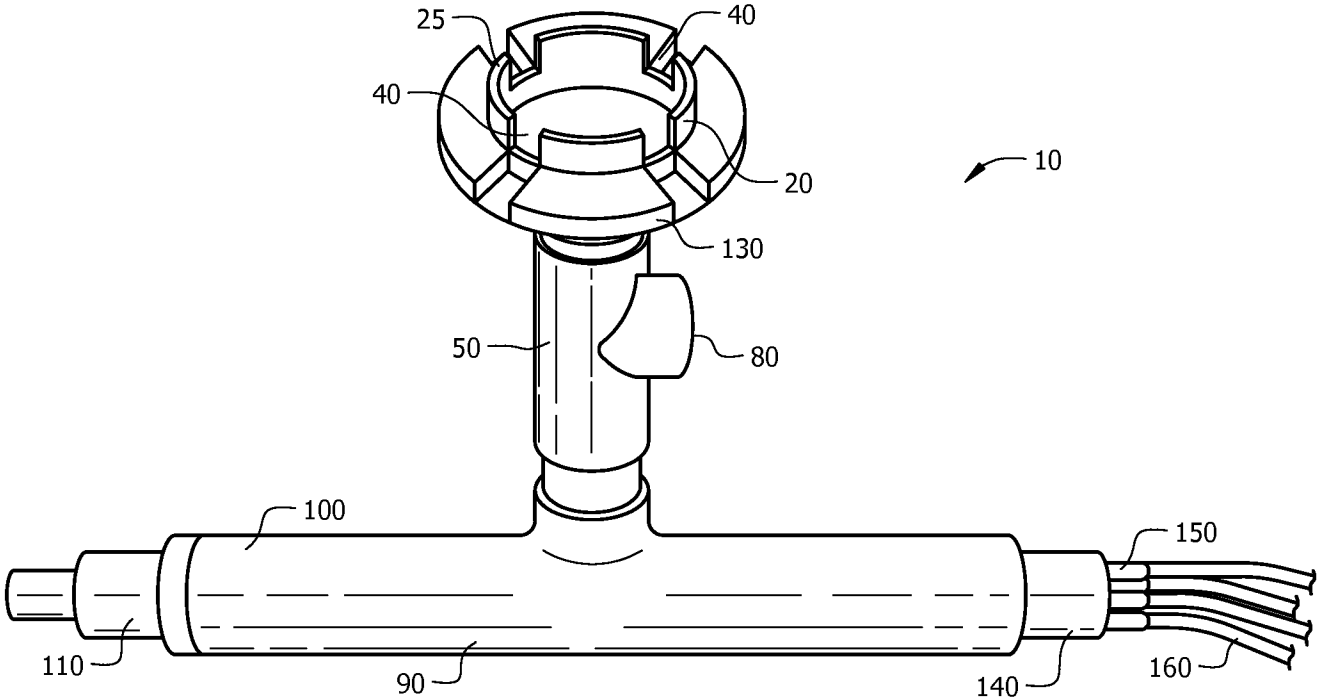
FIG. 9 is a perspective view of another embodiment of the invention showing the flotation apparatus surrounding the vessel.

Another embodiment, shown in FIG. 9, shows the flotation apparatus 130 encircling the circumference of the inlet 20. In this embodiment, the flotation apparatus 130 is substantially circular in shape and is positioned at the first end 25 of the inlet 20. The flotation apparatus 130 should contain notches extending from the inner to the outer circumference of the flotation apparatus 130 that correspond to the weirs 40 in the inlet 20 to allow the surface water to enter the inlet 20. In this embodiment, because the flotation apparatus 130 attaches to and surrounds the inlet 20 to provide buoyancy to the floating skimmer 10, there is no need for a separate flotation assembly.

The floating skimmer 10 is capable of moving around the pool to remove debris from the surface of the pool. In operation, the external suction pump is connected via a hose to the outlet nozzle 110 of the floating skimmer 10. The bottom surface of the flotation apparatus 130 of the floating skimmer 10 is in contact with the surface of the water so that the bottom edge of the weirs 40 are positioned slightly below the surface of the water to allow water to flow into the inlet 20. The inlet 20 draws in floating debris as it moves across the surface of the water. Water and debris entering through the weirs 40 travels down the inlet 20 into the substantially tubular body 50. Water and debris is also entering the substantially tubular body 50 from the intake port 80. The water and debris in the substantially tubular body 50 is driven by the suction of the pump down into the conduit assembly 90. Water and debris can also enter the conduit assembly 90 through any additional intake port or pipe, for instance the intake pipe 170 connected to a hose from an underwater pool vacuum that uses suction to remove debris from the bottom of the pool. In this instance, the debris would travel from the underwater pool vacuum, upwards through a hose connected to the intake pipe 170 and subsequently into the conduit assembly 90. Water and debris such as dust can also enter the conduit assembly 90 through the tubing input assembly 140. Each of the flexible inlet tubes 160 has a different length and thus can intake water and debris from different depths. Water and debris travels upwards through the flexible inlet tubes 160 through the tube inlets 150 and the tubing input assembly 140 into the conduit assembly 90. The water and debris in the conduit assembly 90 that has gathered from all of the various input sources is propelled by suction through the outlet port 100 and outlet nozzle 110 and subsequently through the hose connected to the outlet nozzle 110 to the external suction pump where the debris can be disposed of.

The body of the floating skimmer 10 can be made of any lightweight material capable of acting as a conduit system for water and capable of being suspended by the flotation apparatus 130 in water so that the weirs 40 are located slightly beneath the surface of the water. The material is preferably rigid, strong enough to form tight leak proof attachments and withstand the suction force of the external suction pump. Examples of materials that can be used include, but are not limited to, plastics such as PVC and chlorinated PVC.

The materials used in the present invention can be pipes that are of any shape, diameter, thickness, length and configuration provided that they are waterproof, light enough to be supported by the flotation apparatus, capable of withstanding the suction force of the external suction pump, and enable the flow of water. The pipes, as well as the various parts, utilized in the present invention can be joined together by any known method including but not limited to pipe threads, mechanical coupling, male-female fittings, union fittings, flanges, solvent welding, heat fusion, elastomeric sealing, compression fittings, push-on joints, gasket joints, grooved couplings, and pipe fittings. Various different pipefittings can be used according to the configuration of the apparatus (i.e. the specific configuration of the substantially tubular body and inlet, the flotation apparatus, the conduit assembly and the flotation assembly). These pipefittings include but are not limited to elbow, tee, cross, nipple, and barb fittings.

The flotation apparatus 130 can be made of any material that is capable of lending buoyancy to the floating skimmer 10 when placed in water. These materials can include, but are not limited to, water-resistant foam and materials containing an air pocket for buoyancy.

Any of the input ports or pipes can utilize valves, caps, plugs or covers to restrict water flow through the floating skimmer 10. The valves, caps, plugs or covers can be of any design as long as they effectively restrict the flow of water into the floating skimmer 10. Caps are generally used to cover the end of the pipe and can have female threads. Plugs are similar to caps in that they can also cover the end of a pipe; however, plugs normally have male threads and fit inside the fitting they are mated to. The valves can be operated manually or can automatically close or open when a certain level of water is reached. The foregoing describe only a few of the possible embodiments of the present invention and modifications obvious to one of ordinary skill in the art can be made thereto without departing from the scope of the present invention.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described an illustrated specific embodiments of a floating skimmer, it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention, which, as a matter of language, might be said to fall there between.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A skimmer device for use in a body of water comprising:

an inlet having a first and a second end;

a plurality of weirs disposed around the periphery of the first end of the inlet;

a substantially tubular body having a first end and a second end wherein the first end of the substantially tubular body is in substantially open fluid communication with the second end of the inlet;

an intake port disposed in one side of the substantially tubular body, the intake port providing fluid communication between the outside and inside of said substantially tubular body;

a conduit assembly attached to the second end of the substantially tubular body and having a plurality of ports;

an outlet port disposed within the conduit assembly, the outlet port providing fluid communication between the outside and inside of the conduit assembly;

a tubing input assembly attached to at least one of the plurality of ports of the conduit assembly wherein a plurality of inlet tubes attach to the tubing input assembly; and at least one flotation apparatus attached to the skimmer by at least one flotation assembly to allow the skimmer to float on the surface of the water whereby the weirs are located slightly below the surface of the water.

2. The device of claim 1, wherein the second end of the inlet is tapered downward.

3. The device of claim 1, further comprising a valve attached to the intake port.

4. The device of claim 1, wherein the outlet port is adapted to attach to a hose of a external suction pump.

5. The device of claim 1, wherein the plurality of inlet tubes are flexible and have different lengths.

6. The device of claim 1, wherein at least one port of the conduit assembly attaches to a hose of an underwater vacuum.

7. The device of claim 1, wherein the at least one flotation assembly is attached to the substantially tubular body.

8. The device of claim 1 wherein the at least one flotation apparatus is of a substantially flattened horizontal shape having a top surface and a bottom surface whereby when in use the bottom surface of the at least one flotation apparatus is in contact with water surface.

9. A skimmer device for use in a body of water comprising:

an inlet having a first and a second end;

a plurality of weirs disposed around the periphery of the first end of the inlet;

a substantially tubular body having a first end and a second end wherein the first end of the substantially tubular body is in substantially open fluid communication with the second end of the inlet;

an intake port disposed in one side of the substantially tubular body, the intake port providing fluid communication between the outside and inside of said substantially tubular body;

a conduit assembly attached to the second end of the substantially tubular body and having a plurality of ports;

an outlet port disposed within the conduit assembly, the outlet port providing fluid communication between the outside and inside of the conduit assembly;

a hose having a first and a second end wherein the first end is attached to the outlet port and the second end is attached to an external suction pump;

a tubing input assembly attached to at least one of the plurality of ports of the conduit assembly wherein a plurality of inlet tubes attach to the tubing input assembly; and at least one flotation apparatus attached directly to the inlet of the skimmer to allow the skimmer to float on the surface of the water wherein the at least one flotation apparatus contains a plurality of notches which correspond to the plurality of weirs to allow the water to enter the plurality of weirs;

whereby the weirs are located slightly below the surface of the water.

10. The device of claim 9, wherein the lower end of the inlet is tapered downward.

11. The device of claim 9, further comprising a valve attached to the intake port.

12. The device of claim 9, wherein the at least one port of the conduit assembly is an intake pipe.

13. The device of claim 12, wherein the plurality of inlet tubes are flexible and have different lengths.

14. The device of claim 9, wherein at least one port of the conduit assembly attaches to a hose of an underwater vacuum.

* * * * *

UNITED STATES PATENT AND TRADEMARK OFFICE

CERTIFICATE OF CORRECTION

PATENT NO. : 8,475,656 B1
APPLICATION NO. : 12/839862
DATED : July 2, 2013
INVENTOR(S) : Michael E. Neumann It is certified that error appears in the above-identified patent and that said Letters Patent is hereby corrected as shown below:

Title Page:

Item (76) Inventor should read

-- Michael E. Neumann, Tarpon Springs, FL (US) --

Signed and Sealed this
Third Day of September, 2013

Teresa Stanek Rea
*Acting Director of the United States Patent and Trademark Office*